US008092190B2

(12) United States Patent
Leuthen et al.

(10) Patent No.: US 8,092,190 B2
(45) Date of Patent: Jan. 10, 2012

(54) SYSTEMS AND METHODS FOR REDUCING PUMP DOWNTIME BY DETERMINING ROTATION SPEED USING A VARIABLE SPEED DRIVE

(75) Inventors: John M. Leuthen, Claremore, OK (US); Sheldon Plitt, Leduc (CA); Jerald R. Rider, Catoosa, OK (US); Tom G. Yohanan, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 952 days.

(21) Appl. No.: 12/061,241

(22) Filed: Apr. 2, 2008

(65) Prior Publication Data

US 2008/0247880 A1 Oct. 9, 2008

Related U.S. Application Data

(60) Provisional application No. 60/910,470, filed on Apr. 6, 2007.

(51) Int. Cl.
*F04B 49/06* (2006.01)
*H02P 1/16* (2006.01)

(52) U.S. Cl. ..... 417/44.11; 417/44.1; 417/423.7; 417/53; 318/291; 318/456; 318/461

(58) Field of Classification Search ..... 417/44.1, 417/44.11, 423.3, 53; 318/291, 432, 434, 318/456, 461
See application file for complete search history.

(56) References Cited

U.S. PATENT DOCUMENTS

| | | | | | |
|---|---|---|---|---|---|
| 4,410,845 | A * | 10/1983 | Lockyear | 318/459 |
| 5,198,734 | A * | 3/1993 | Johnson | 318/369 |
| 5,475,292 | A * | 12/1995 | Nakanishi et al. | 318/705 |
| 5,825,143 | A * | 10/1998 | Montgomery | 318/381 |
| 5,973,465 | A * | 10/1999 | Rayner | 318/459 |
| 7,330,779 | B2 * | 2/2008 | Schulz | 700/282 |

FOREIGN PATENT DOCUMENTS

| | | |
|---|---|---|
| DE | 10213563 | 3/2002 |
| GB | 2334284 | 2/1999 |

* cited by examiner

*Primary Examiner* — Charles Freay
(74) *Attorney, Agent, or Firm* — Law Offices of Mark L. Berrier

(57) ABSTRACT

Systems and methods for using variable speed drives to restart downhole submersible pump motors. In one embodiment, a downhole pump is controlled using a variable speed drive that includes a control system configured to detect interruptions in the operation of the pump system. After an interruption that requires the restart of the pump motor, the control system determines the reverse rotational speed of the pump motor and restarts the motor when this speed is sufficiently low. The control system may be configured to reduce the output voltage of the variable speed drive and sweep through a range of output frequencies to determine the frequency at which the current drawn by the motor is lowest. This is the frequency at which the drive's output matches the speed of the motor and the apparent impedance of the motor is highest. When the speed is low enough, the motor is restarted.

22 Claims, 4 Drawing Sheets

SYSTEMS AND METHODS FOR REDUCING PUMP DOWNTIME BY DETERMINING ROTATION SPEED USING A VARIABLE SPEED DRIVE

CROSS-REFERENCE TO RELATED APPLICATIONS

This application claims the benefit of U.S. Provisional Patent Application 60/910,470, filed Apr. 6, 2007, which is hereby incorporated by reference as if set forth herein in its entirety.

BACKGROUND

1. Field of the Invention

The invention relates generally to electrical control systems, and more particularly to systems and methods implemented in variable speed drives for electric submsersible pumps to determine when a pump can be restarted.

2. Related Art

Crude oil is typically produced by drilling wells into oil reservoirs and then pumping the oil out of the reservoirs through the wells. Often, the oil is pumped out of the wells using electric submersible pumps. Electrical power is provided to electrical drive systems at the surface of the wells and these drive systems provide the required electrical power to the downhole pumps.

While downhole pumps are designed to operate continuously, they are subject to interruptions that can result from a number of different causes. For example, changes in well conditions (e.g., the appearance of gas in an oil well) may cause the pump to stop operating. Interruptions or variations in the power supplied to a pump's drive system may also cause operation of the pump to be interrupted. Even if these interruptions in the operation of the pump are relatively short, they may nevertheless be very disruptive, particularly when the pumps are submersible pumps operated in deep wells.

These interruptions may be very disruptive because submersible pumps, which must fit in a well and must therefore be long and narrow, have very little inertia. Consequently, when there is a change in conditions which causes an interruption, these pumps slow down or stop very quickly in comparison to pumps which have more inertia, such as surface pumps. The deceleration of the pump is even more pronounced in deep wells due to the large fluid column above the pump. Normally, when the operation of the pump is interrupted for longer than about half a second, the pump will have begun to spin in reverse.

Typically, there is some speed below which the pressure produced by the pump is insufficient to support the column of fluid. When the rotation of the pump falls below this speed, the fluid starts to fall back through the well and through the pump, dramatically increasing the torque required to resume forward rotation of the pump. While it is possible to match the speed of the pump motor, slow its reverse spin and start it spinning forward again, this often requires a great deal of torque. The torque that can be generated by the pump system may be limited by such factors as the output of the drive for the pump motor, the impedance of the cable carrying the power downhole, etc., so restarting the pump motor may require more torque than the system can generate. It is therefore typically necessary to stop the pump and wait for the column of fluid to drain from the well before the pump can be restarted. The time required for the fluid column to drain back into the formation may take a few minutes in some cases, while in other cases it may take more than an hour.

Normally, when it is necessary to restart a pump, an operator waits for a predetermined period and then restarts the pump. The wait period is typically determined by adding the amount of time necessary for the fluid to completely drain from the well and a safety margin (for example, an additional 25%.) Because each well may normally produce hundreds or even thousands of barrels of oil in a day, the cost associated with the delay between the pump stopping and being restarted can be very high. There is therefore a need to minimize the delay between the time the pump stops and the time the pump is restarted.

SUMMARY OF THE INVENTION

This disclosure is directed to systems and methods for using variable speed drives to restart downhole submersible pump motors that solve one or more of the problems discussed above. In one particular embodiment, a downhole electric submersible pump deployed in a well is controlled using a variable speed drive. The variable speed drive includes a control system which is configured to detect interruptions in the operation of the pump system. If the control system detects a power interruption or some other interruption that requires the restart of the pump motor, the control system determines the reverse rotational speed of the pump motor and restarts the motor when this speed is sufficiently low. In this embodiment, the control system is configured to reduce the output voltage of the variable speed drive and sweep through a range of output frequencies to determine the frequency at which the current drawn by the motor is lowest. This is the frequency at which the apparent impedance of the motor is highest, indicating that the frequency of the variable speed drive's output matches the speed of the motor. The reverse rotational speed of the motor is known from this frequency, so the control system determines whether the speed is low enough that the pump system has sufficient torque to restart. If the speed is low enough, the motor is restarted. Otherwise, the control system continues to monitor the speed of the motor and restarts the motor after its speed is determined to be sufficiently low.

One embodiment comprises a method for restarting a downhole pump. The method includes determining a reverse rotational speed of the pump's motor, determining whether this speed is sufficiently low to restart the motor, and restarting the motor if the speed is low enough. A threshold speed may be used to gauge whether the reverse rotational speed of the motor is low enough to restart the motor. The method may be implemented in response to detecting an interruption in the operation of the downhole pump which requires the downhole pump motor to be restarted. For example, a change in well conditions or an interruption of power to a variable speed drive that drives the motor may cause the forward rotation of the motor to slow and even rotate in reverse. Ride-through procedures may be implemented to try to maintain pump operation despite the power interruption, but if these procedures are not successful, detection of the motor speed and restarting of the motor according to the above method will proceed.

In one embodiment, the reverse rotational speed of the pump's motor is determined by reducing the output voltage of the variable speed drive, operating the drive at a range of output frequencies and determining which of the frequencies the lowest current is drawn by the motor. At this frequency, the apparent impedance of the motor is highest, indicating that the frequency of the variable speed drive matches the speed of the motor. When the frequency is known, it can be determined whether the motor can be restarted. In one embodiment, the motor is restarted when the speed falls below a threshold below which the pump system has sufficient torque to restart. In another embodiment, the motor is restarted when the speed nears 0.

Another embodiment comprises a variable speed drive which is configured to drive a downhole pump motor. The variable speed drive includes a control system which is configured to determine the reverse rotational speed of the pump's motor, determine whether this speed is sufficiently low to restart the motor, and restart the motor if possible. The Variable speed drive may, for instance, restart the pump motor when the reverse rotational speed of the motor falls below a threshold below which the pump system has sufficient torque to restart. This procedure may be initiated in response to interruption of the pump's operation (e.g., interruption of the power to the variable speed drive) and may follow implementation of ride-through procedures that are designed to maintain the pump's operation through a power interruption.

Numerous other embodiments are also possible.

The various embodiments of the invention may provide a number of advantages over the prior art. For example, the present systems and methods may reduce the amount of waiting time that is necessary before attempting to restart the pump motor. This reduction in the waiting time reduces the amount of lost production resulting from interruptions in the pump's operation. Still other advantages may also be provided.

BRIEF DESCRIPTION OF THE DRAWINGS

Other objects and advantages of the invention may become apparent upon reading the following detailed description and upon reference to the accompanying drawings.

Figure 1:
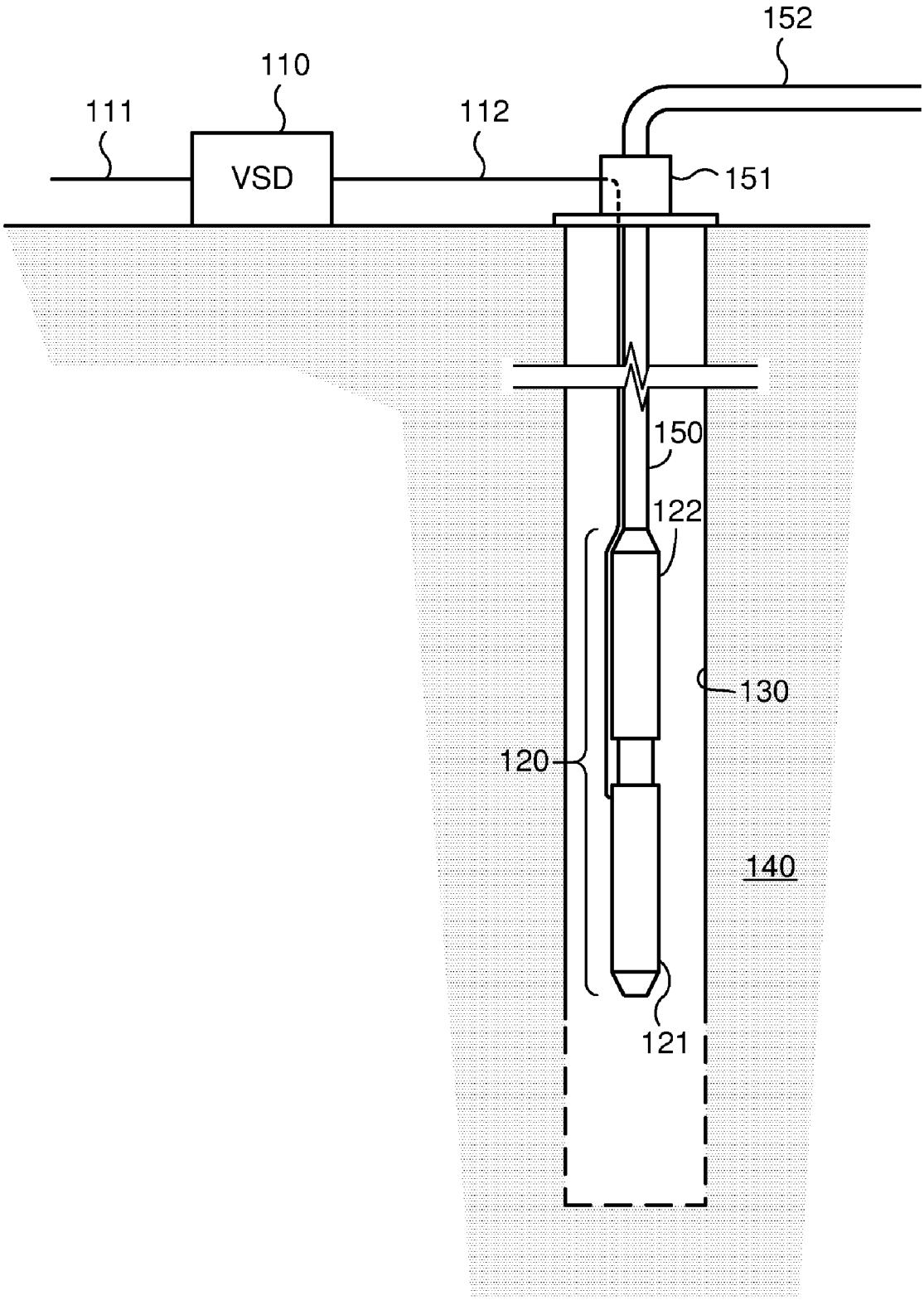
FIG. 1 is a diagram illustrating an electric submersible pump and control system in accordance with one embodiment.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims.

DETAILED DESCRIPTION OF PREFERRED EMBODIMENTS

One or more embodiments of the invention are described below. It should be noted that these and any other embodiments described below are exemplary and are intended to be illustrative of the invention rather than limiting.

As described herein, various embodiments of the invention comprise systems and methods for using a variable speed drive to determine the rotational speed of an electric submersible pump following an interruption of the normal operation of the pump and to thereby determine when the pump can be restarted with minimal delay, rather than having to wait for a period of time that may be longer than necessary.

In one embodiment, a downhole electric submersible pump deployed in a well is controlled using a variable speed drive. The variable speed drive includes converter and inverter sections, as well as a capacitor bank and control systems. The drive receives AC input power (subject to interruptions and/or variations) and generates output power which is suitable for driving the pump. The drive is configured to detect disruptions in the supplied AC power, ride through these disruptions if possible, and thereby prevent at least some of the interruptions that would otherwise be experienced in the normal operation of the pump.

In this embodiment, if the variable speed drive detects an interruption of the input power, or if there is a voltage drop on the input power line that exceeds a threshold level, this signifies the beginning of a ride-through event. Upon detecting the beginning of a ride-through event, the control system of the drive shuts off the drive's converter section and draws energy from the capacitor bank to continue operation of the inverter section and thereby continue to provide power to the pump. If the disruption on the input line ends (or if the line begins returning to its normal voltage,) this signifies the end of the ride-through event. If the ride-through event is short enough to have maintained operation of the pump, the control system resumes operation of the converter in a controlled manner in order to avoid a sudden inrush of current that would otherwise damage the drive. The control system causes the drive to slowly recharge the capacitor bank and return to normal operating conditions.

After operation of the drive stops (due to changing well conditions or power interruptions, for example,) the forward rotation of the pump slows and then reverses as the column of fluid in the well drains back down through the pump and into the formation. In order to determine the reverse rotation speed of the pump, the drive is controlled to produce an output drive signal to the pump motor which has a relatively low voltage and a varying frequency. The frequency of the signal is swept through a range which corresponds to a range of reverse pump motor speeds. When the frequency of the drive signal matches the frequency of the pump motor, the apparent impedance of the motor will increase to a maximum value, causing the output current of the drive to decrease to a minimum. When the drive identifies a drop in the output current to substantially its minimum value, the drive speed is known to match the motor speed.

It should be noted that "substantially" is used herein to indicate that it is not necessary to determine the exact value of the described property. For instance, it is not necessary to determine the exact frequency corresponding to the minimum motor current—it is sufficient to determine a frequency that is near the minimum current (i.e., the frequency that substantially minimizes the current or substantially maximizes the impedance.)

If the pump system has enough torque to restart at the identified speed, it can be immediately restarted. If the system does not have enough torque to restart immediately, the drive continues to match the motor speed until the motor speed falls below a threshold level at which the pump system has sufficient torque to restore forward rotation of the pump and support the column of fluid in the well. The pump can then be restarted. Alternatively, the drive can continue to match the motor speed until it is determined that the motor has stopped, at which point the pump can be restarted. It should be noted that, if the drive sweeps through the range of frequencies at which the pump motor may be spinning and does not detect any drops in output current, it can be assumed that the pump has stopped spinning and can be restarted normally.

Referring to FIG. 1, a diagram illustrating an electric submersible pump and control system in accordance with one embodiment is shown. In this embodiment, a variable speed drive 110 is coupled to an electric submersible pump 120. Pump 120 is positioned within a wellbore 130 which has been drilled into an oil-bearing geological structure 140. Wellbore 130 is cased and is perforated at the lower end of the well to allow oil to flow from the formation into the well.

Pump 120 is coupled to the end of tubing string 150. Pump 120 and tubing string 150 are lowered into the wellbore to position the pump in producing portion of the well (i.e., the perforated portion.) Pump 120 is then operated in order to pump oil from the producing portion of the well, through tubing string 150 to well head 151. The oil then flows out through production flow line 152 and into storage tanks (not shown in the figure.)

Pump 120 includes an electric motor section 121 and a pump section 122. (It should be noted that pump 120 may include various other components which will not be described in detail here because they are well known in the art and are not important to a discussion of the invention.) Motor section 121 is operated to drive pump section 122, which actually pumps the oil through the tubing string and out of the well. In this embodiment, motor section 121 uses an induction motor which is driven by variable speed drive 110. Variable speed drive 110 receives AC (alternating current) input power from an external source such as a generator (not shown in the figure) via input line 111. Drive 110 rectifies the AC input power and then produces output power that is suitable to drive motor section 121 of pump 120. This output power is provided to motor section 121 via drive output line 112, which runs down the wellbore along tubing string 150.

Figure 2:
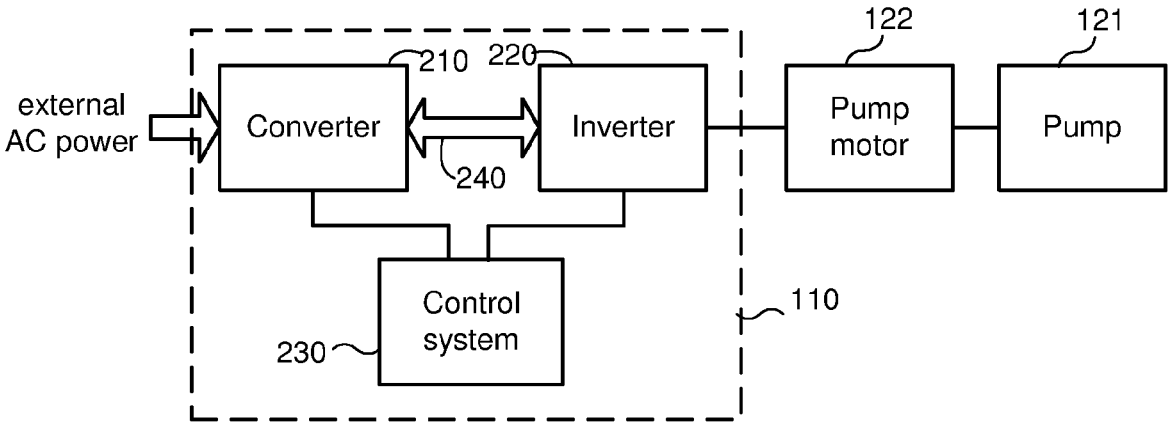
FIG. 2 is a functional block diagram illustrating the general structure of a system including a variable speed drive and pump in accordance with one embodiment.

Referring to FIG. 2, a functional block diagram illustrating the general structure of a system including a variable speed drive and pump in accordance with one embodiment is shown. Variable speed drive 110 includes a converter section 210 and an inverter section 220. The purpose of converter section 210 is to rectify the AC voltage received from the external power source. Converter section 210 generates DC power which is passed through an LC filter. The DC voltage generated by converter section 210 charges a capacitor bank coupled to bus 240 to a desired voltage. The desired voltage is achieved by controlling the operation of converter section 210. The voltage on bus 240 is then used to drive inverter section 220. The purpose of inverter section 220 is to connect the bus voltage to the output terminals in prescribed manners to generate various output waveforms. Examples of the types of output waveforms that may be generated by inverter section 220 are described in more detail in U.S. Pat. No. 6,043,995. The output power produced by inverter section 220 may be filtered and then provided via an output line to pump motor 122, which then drives pump 121.

Converter section 210 and inverter section 220 operate according to control signals received from a control system 230 of the variable speed drive. For example, the control system determines the timing with which the SCRs (silicon controlled rectifiers) of the converter section are turned on or "fired." This timing determines when, and for how long, the external voltage on the input line is applied to the bus, and thereby controls the bus voltage. If the SCRs are turned on as soon as the input line voltage goes positive, the SCRs will be switched on for the maximum amount of time, causing the bus voltage to move toward its maximum. If the switching on of the SCRs is delayed, they will be switched on for less than the maximum amount of time, and a lower bus voltage will be achieved. The control section of the variable speed drive similarly controls the operation of inverter section 220. The control section selects the desired output mode (e.g., standard PWM mode, six-step mode, or hybrid mode,) and adjusts the output voltage by varying appropriate factors. For instance, in the PWM mode, the bus voltage is set to maximum by firing the SCR at the earliest time and the output voltage is controlled by adjusting a scale factor of the output waveform called the modulation index. In the hybrid or six-step mode, the scale factor is set to 100 percent, and the output voltage is determined by the bus voltage which is controlled by the firing of the SCRs. In all three modes, the output frequency (and therefore the speed of the pump) is a function of the output voltage.

Another function of the control system is to implement algorithms relating to interruption of the pump's operation. These algorithms may implement procedures to ride through power disturbances and/or to restart the pump with minimal delay after operation of the pump is interrupted. It should be noted that the ride-through algorithms need not be implemented in all embodiments. It should also be noted that the interruptions in the operation of the pump may result from various causes other than simply power interruptions.

In this embodiment, if the variable speed drive detects an interruption of the input power, or if there is a voltage drop on the input power line that exceeds a threshold level, this signifies the beginning of a ride-through event. Upon detecting the beginning of a ride-through event, the control system of the drive shuts off the drive's converter section and draws energy from the capacitor bank to continue operation of the inverter section and thereby continue to provide power to the pump. If the disruption on the input line ends (or if the line begins returning to its normal voltage,) this signifies the end of the ride-through event. If the ride-through event is short enough to have maintained operation of the pump, the control system resumes operation of the converter in a controlled manner in order to avoid a sudden inrush of current that would otherwise damage the drive. The control system causes the drive to slowly recharge the capacitor bank and return to normal operating conditions.

Figure 3:
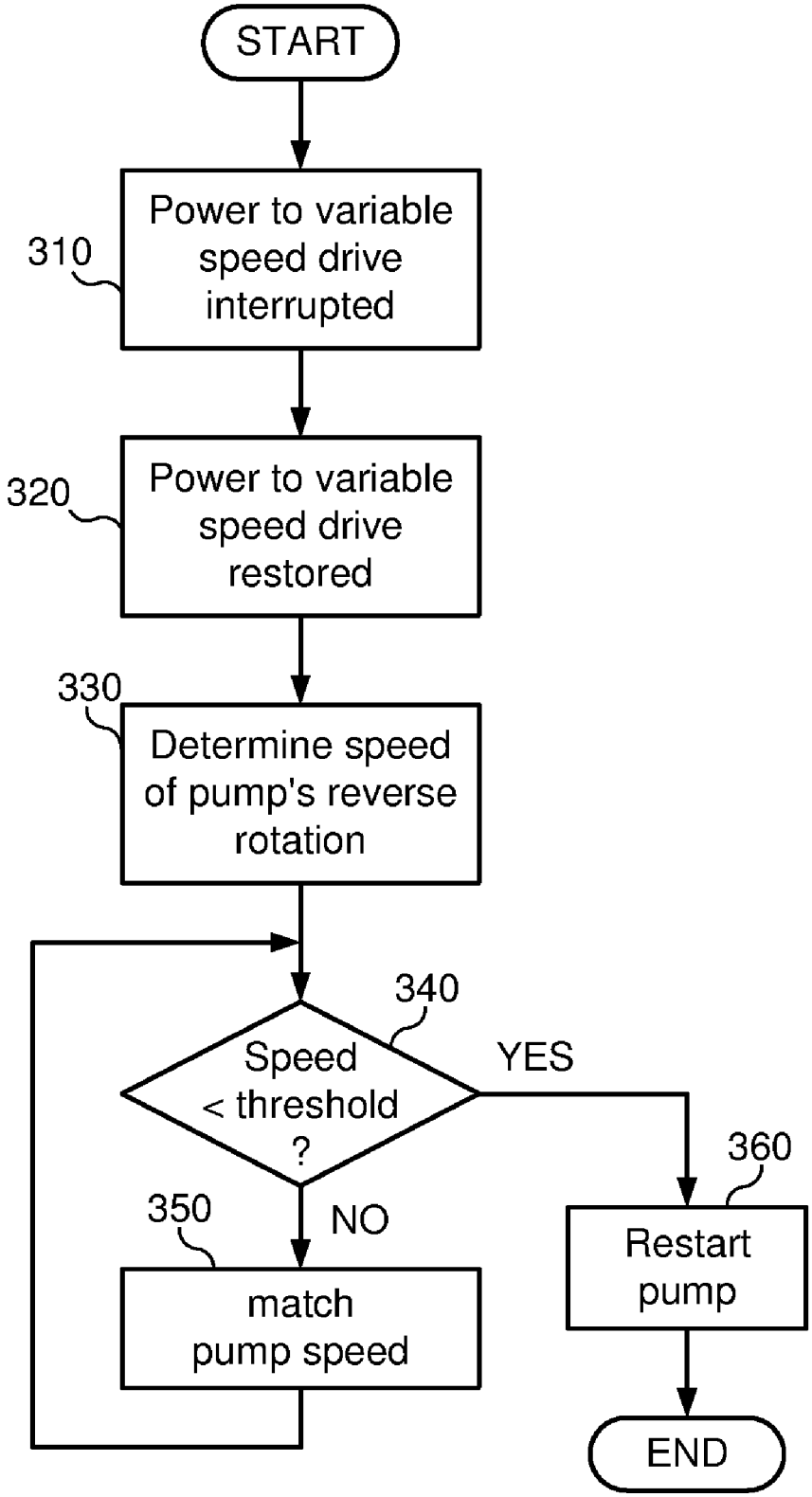
FIG. 3 is a flow diagram illustrating the determination of the pump speed and the subsequent restarting of the pump in accordance with one embodiment.

If the disruption on the input line is too long, the variable speed drive will not be able to ride through the event, and it will be necessary to restart the pump. The drive therefore implements algorithms to determine the pump's speed and to restart the pump with minimal delay after the interruption. Referring to FIG. 3, a flow diagram illustrating the determination of the pump speed and the subsequent restarting of the pump is shown. Initially, the variable speed drive is operating normally, receiving external AC power, converting this to DC power, and then generating output AC power at a voltage and frequency which are appropriate to drive the pump motor at a desired speed. At block 310, power to the variable speed drive is interrupted. It is assumed that the interruption is long enough that the drive cannot ride-through the interruption and maintain a suitable output voltage to continue to drive the pump motor. At some point, power is restored to the drive (block 320,) and the drive's control system implements an algorithm (beginning with block 330) to restart the pump with minimal delay.

When the drive's control system determines that there has been an interruption (whether it to a power interruption or other causes,) it must determine the speed of the pump's rotation. As noted above, the pump may not be able to develop sufficient torque to support the column of fluid in the well if the fluid is draining too quickly back into the well and causing the pump to spin too quickly in reverse. It is therefore necessary to determine the pump speed in order to determine whether the pump can be restarted. The manner in which the speed of the pump is determined will be described below in more detail in connection with FIG. 4.

When the speed of the pump has been determined, the control system determines whether the speed is below a threshold (block 340.) At speeds above this threshold, the pump does not have sufficient torque to restart. If the speed of the pump is below this threshold, the pump can develop sufficient torque, so it is restarted (block 360.) If the speed of the pump is not below the threshold, the drive matches the speed of the pump (block 350,) thereby tracking the speed as the pump decelerates. The drive periodically compares the pump speed to the threshold speed (block 340) to determine whether the pump can be restarted. This continues until the pump speed falls below the threshold, at which point the pump is restarted (block 360.)

It should be noted that the threshold frequency may either be a static value or a variable. In one embodiment, the various factors that may affect the ability to restart the pump (which may vary from one case to another) may be considered and a corresponding threshold value calculated. If some of the factors are variable in a particular situation, the static value may be conservatively calculated by assuming the worst-case conditions for restarting the pump. Alternatively, the drive's control system may be configured to dynamically calculate the threshold value based upon existing conditions.

Figure 4:
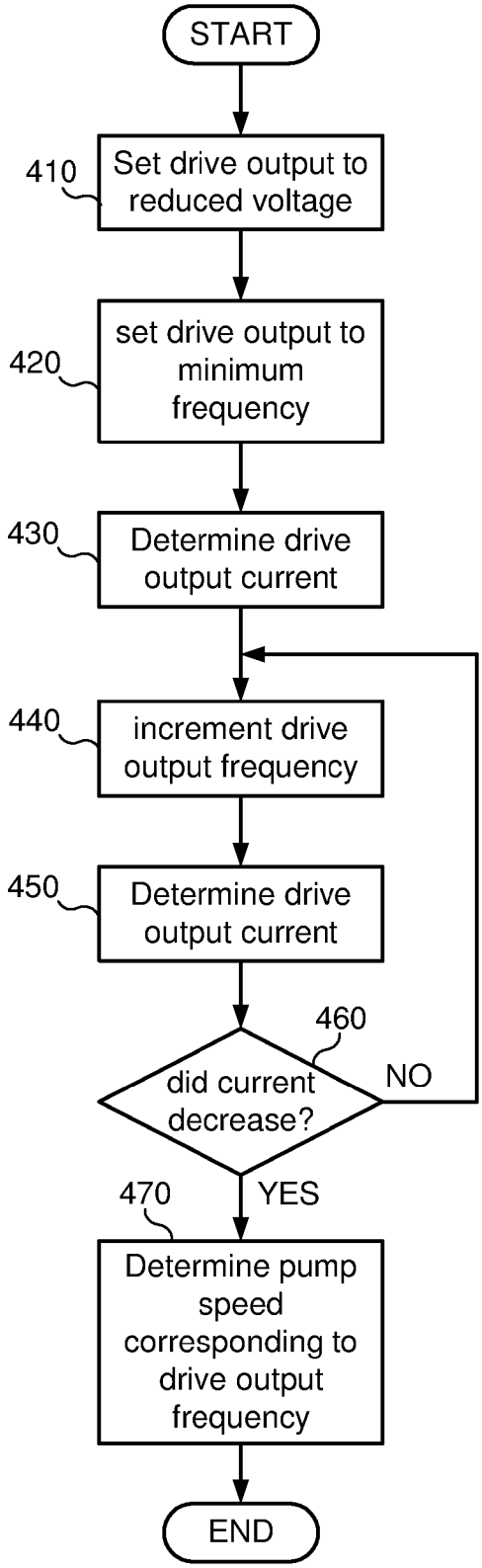
FIG. 4 is a flow diagram illustrating an algorithm by which the variable speed drive can determine the pump speed in accordance with one embodiment.

Referring to FIG. 4, a flow diagram illustrating an algorithm by which the variable speed drive can determine the pump speed is shown. In this embodiment, the output voltage of the drive is first reduced to a level which is substantially less than the typical operating voltage produced by the drive (block 410.) For example, if the drive normally provides a 480 volt output, the output may be reduced to 40, or even 4 volts. The output voltage is reduced because, when the output of the drive does not match the speed of the pump, the apparent impedance of the pump motor is very low. The output current of the drive could therefore be dangerously high, and the drive could be damaged, if the normal output voltage (e.g., 480 volts) were used.

The frequency of the drive's output is initially set to a minimum value (block 420.) In some embodiments, this minimum value could be a few hertz (Hz.) In other embodiments, it could be different. The frequency of the drive's output is then swept from the minimum frequency to a maximum frequency to determine the frequency at which the drive's output current "dips." In the embodiment of FIG. 4, this is accomplished by determining the output current at successive frequencies and comparing the measured currents to identify the dip at which the frequency matches (or very nearly matches) the speed of the pump motor.

Referring again to FIG. 4, the output current of the drive at the initial frequency (e.g., 3-5 Hz) is determined (block 430.) Then, the output frequency of the drive is incremented to a slightly higher frequency (block 440) and the output current at the new frequency is determined (block 450.) The two output currents are then compared in order to determine whether or not the current decreased with the change in frequency (block 460.) Typically, the drive's output current will remain relatively constant (assuming constant output voltage) until the frequency is within 0.5-1.0 Hz of the pump motor speed. Thus, if the drive's output current decreases with the change in frequency, it can be assumed that the new frequency is nearly the same (within 0.5-1.0 Hz) as the speed of the pump motor.

If, at block 460, the output current does not decrease with the increase in frequency, it can be assumed that the sweep of the frequencies has not yet reached the frequency corresponding to the current pump speed. Consequently, the algorithm loops back, incrementing the frequency of the drive's output (block 440,) determining the output current corresponding to the new frequency (block 450,) and again testing the current to determine whether it decreased from the current associated with the previous frequency (block 460.) The algorithm thus loops through blocks 440-460 until the output frequency of the drive reaches the frequency corresponding to the current pump speed.

As noted above, the algorithm for determining the pump speed and restarting the pump is implemented in the control system of the drive. The control system may include any suitable type of data processor configured to execute the instructions of a control program, as well as some type of computer-readable medium for storing the instructions. It should also be noted that one embodiment of the invention may comprise the control program itself.

It should also be noted that the embodiment described above in connection with FIGS. 3 and 4 is exemplary, and many variations are possible in alternative embodiments. For example, the algorithm that FIG. 3 assumes that the interruption of the drive's operation has been sufficiently long to allow the pump to begin to spin in reverse. In alternative embodiments, the algorithm may be designed to determine the pump speed, regardless of whether or not the pump has reversed its spin. One alternative embodiment may, for instance, sweep the entire range of possible frequencies corresponding to both reverse and forward rotation of the pump. Another alternative embodiment may include a mechanism to determine whether the drive has been interrupted for a relatively short period of time. If the interruption was short, the control system may sweep frequencies corresponding to the forward and reverse rotation of the pump. If the interruption was relatively long, the control system may simply sweep frequencies corresponding to reverse rotation of the pump.

Another variation that may be made in alternative embodiments also relates to the manner in which the drive sweeps through the frequencies. In the embodiment described in connection with FIGS. 3 and 4, the frequencies are swept from the minimum frequency to the maximum frequency. The frequencies may instead be swept in the reverse order (beginning with the maximum frequency and ending with the minimum frequency.) The minimum-to-maximum or maximum-to-minimum frequency alternatives could be applied with respect to both forward and reverse rotation of the pump.

Still other possible variations relate to the identification of the "dip" in the drive's output current corresponding to the drive output frequency that matches the pump's rotation. In the embodiment described above, the output currents associated with successively incremented frequencies are compared to determine when the current decreases (the dip corresponding to the frequency of the pump motor.) In another embodiment, the outputs corresponding to successive frequencies can be compared to determine whether the current at the higher frequency is greater than the current at the lower frequency. This would indicate that the dip in the current has just been passed (i.e., that the lower of the two frequencies corresponds to the pump motor speed.) In still other embodiments, an entire range of frequencies could be swept, and the minimum output current (and corresponding frequency) in the range could be identified.

In still another variation, the speed of the pump motor can be determined by examining the torque of the system as the frequency of the drive output is swept through the range of possible frequencies. As the frequency is varied, it will be seen that the torque changes polarity at the frequency which matches the speed of the pump motor. This polarity change can be identified using algorithms similar to those used above to identify dips in the pump motor current.

Many other variations on the above embodiments will be apparent to those of skill in the art.

Those of skill will appreciate that some of the illustrative logical blocks, modules, circuits, and algorithm steps described in connection with the embodiments disclosed herein may be implemented as electronic hardware, computer software (including firmware,) or combinations of both. To clearly illustrate this interchangeability, various illustrative components, blocks, modules, circuits, and steps have been described above generally in terms of their functionality. Whether such functionality is implemented as hardware or software depends upon the particular application and design constraints imposed on the overall system. Those of skill in the art may implement the described functionality in varying ways for each particular application, but such implementation decisions should not be interpreted as causing a departure from the scope of the present invention.

The benefits and advantages which may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms "comprises," "comprising," or any other variations thereof, are intended to be interpreted as non-exclusively including the elements or limitations which follow those terms. Accordingly, a system, method, or other embodiment that comprises a set of elements is not limited to only those elements, and may include other elements not expressly listed or inherent to the claimed embodiment.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims.

What is claimed is:

1. A method for restarting a downhole pump comprising:

determining a reverse rotational speed of a downhole pump motor;

determining whether the reverse rotational speed of the downhole pump motor is sufficiently low to restart the pump motor by varyinq a frequency of a variable speed drive which controls the motor, monitorinq a characteristic of the motor, and determining the frequency at which the monitored characteristic of the motor indicates that the frequency matches the speed of the motor, and determining the reverse rotational speed of the downhole pump from the frequency that matches the speed of the motor; and when the reverse rotational speed of the downhole pump motor is sufficiently low, restarting the downhole pump motor.

2. The method of claim 1, further comprising performing the method of claim 1 in response to detecting an interruption of the operation of the downhole pump that requires the downhole pump motor to be restarted.

3. The method of claim 2, wherein detecting an interruption of the operation of the downhole pump comprises detecting an interruption of power to a variable speed drive which is coupled to the downhole pump motor and configured to drive the downhole pump motor.

4. The method of claim 3, further comprising performing a ride-through procedure in response to detecting the interruption of power to the variable speed drive and performing the method of claim 1 following the ride-through procedure.

5. The method of claim 1, wherein the characteristic comprises an apparent impedance of the motor, wherein determininq the frequency at which the monitored characteristic of the motor indicates that the frequency matches the speed of the motor comprises determining the frequency at which the apparent impedance of the motor is substantially maximized.

6. The method of claim 5, wherein determining the frequency at which the apparent impedance of the motor is substantially maximized comprises determining the frequency at which a current drawn by the motor is substantially minimized.

7. The method of claim 1, wherein determining the frequency at which the current drawn by the motor is substantially minimized comprises reducing an output voltage of the variable speed drive, then determining the current drawn by the motor at multiple frequencies and determining at which of the frequencies the current drawn by the motor is substantially minimized.

8. The method of claim 1, wherein determining whether the reverse rotational speed of the pump motor is sufficiently low to restart the pump motor comprises determining whether the reverse rotational speed of the pump motor is below a threshold reverse rotational speed.

9. The method of claim 8, wherein the method is implemented in a pump system that includes the downhole pump and the downhole pump motor, and wherein the threshold reverse rotational speed comprises a speed below which the pump system has sufficient torque to restart.

10. The method of claim 1, further comprising when the reverse rotational speed of the downhole pump motor is substantially 0, restarting the downhole pump motor.

11. A device comprising:

a variable speed drive for a downhole pump;

wherein the variable speed drive includes a control system configured to determine a reverse rotational speed of a downhole pump motor by varying a frequency of the variable speed drive, monitoring a characteristic of the motor, determining the frequency at which the monitored characteristic of the motor indicates that the frequency matches the speed of the motor, and determining the reverse rotational speed of the downhole pump from the frequency that matches the speed of the motor, determine whether the reverse rotational speed of the downhole pump motor is sufficiently low to restart the pump motor, and when the reverse rotational speed of the downhole pump motor is sufficiently low, restart the downhole pump motor.

12. The device of claim 11, wherein the control system is configured to determine the reverse rotational speed of the downhole pump motor in response to detecting an interruption of the operation of the downhole pump that requires the downhole pump motor to be restarted.

13. The device of claim 12, wherein the control system is configured to detect an interruption of the operation of the downhole pump by detecting an interruption of power to the variable speed drive.

14. The device of claim 13, wherein the control system is configured to perform a ride-through procedure in response to detecting the interruption of power to the variable speed drive and to determine the reverse rotational speed of the downhole pump motor following the ride-through procedure.

15. The device of claim 11, wherein the characteristic comprises an apparent impedance of the motor, wherein determining the frequency at which the monitored characteristic of the motor indicates that the frequency matches the speed of the motor comprises determining the frequency at which the apparent impedance of the motor is substantially maximized.

16. The device of claim 15, wherein the control system is configured to determine the frequency at which the apparent impedance of the motor is substantially maximized by determining the frequency at which a current drawn by the motor is substantially minimized.

17. The device of claim 16, wherein the control system is configured to determine the frequency at which the current drawn by the motor is substantially minimized by reducing an output voltage of the variable speed drive, then determining the current drawn by the motor at multiple frequencies and determining at which of the frequencies the current drawn by the motor is substantially minimized.

18. The device of claim 11, wherein the control system is configured to restart the downhole pump motor when the reverse rotational speed of the downhole pump motor is below a threshold reverse rotational speed.

19. The device of claim 18, wherein the variable speed drive, the downhole pump and the downhole pump motor are components of a pump system, and wherein the threshold reverse rotational speed comprises a speed below which the pump system has sufficient torque to restart.

20. The device of claim 11, wherein the control system is configured to restart the downhole pump motor when the reverse rotational speed of the downhole pump motor is substantially 0.

21. A system comprising:

a downhole pump having a pump motor; and a variable speed drive coupled to the pump motor;

wherein the variable speed drive includes a control system configured to determine a reverse rotational speed of a downhole pump motor by varying a frequency of the variable speed drive, monitoring a characteristic of the motor, determining the frequency at which the monitored characteristic of the motor indicates that the frequency matches the speed of the motor, and determining the reverse rotational speed of the downhole pump from the frequency that matches the speed of the motor, determine whether the reverse rotational speed of the downhole pump motor is sufficiently low to restart the pump motor, and when the reverse rotational speed of the downhole pump motor is sufficiently low, restart the downhole pump motor.

22. The system of claim 21, wherein the control system is configured to:

perform a ride-through procedure in response to detecting an interruption of power to the variable speed drive;

to determine the reverse rotational speed of the downhole pump motor following the ride-through procedure; and determine the reverse rotational speed of the downhole pump by reducing an output voltage of the variable speed drive, then determining a current drawn by the motor at each of multiple output frequencies of the variable speed drive, determining at which of the frequencies the current drawn by the motor is substantially minimized, and determining the reverse rotational speed of the downhole pump from the frequency at which the current drawn by the motor is substantially minimized.

* * * * *